United States Patent [19]

Matsumoto

[11] Patent Number: 5,033,673

[45] Date of Patent: Jul. 23, 1991

[54] HOT WATER CIRCULATING SYSTEM

[75] Inventor: Motoki Matsumoto, Aichi, Japan

[73] Assignee: Toyotomi Co., Ltd., Japan

[21] Appl. No.: 514,883

[22] Filed: Apr. 26, 1990

[30] Foreign Application Priority Data

| | | | |
|---|---|---|---|
| Apr. 29, 1989 | [JP] | Japan | 1-109891 |
| May 31, 1989 | [JP] | Japan | 1-137927 |
| May 31, 1989 | [JP] | Japan | 1-137928 |
| Jan. 30, 1990 | [JP] | Japan | 2-19817 |

[51] Int. Cl.[5] ..... F24D 3/00

[52] U.S. Cl. ..... 237/60

[58] Field of Search ..... 237/60, 59, 64, 66, 237/19, 6; 122/33, 40

[56] References Cited

U.S. PATENT DOCUMENTS 492,166 5/1990 Matsumoto et al. ..... 237/60

FOREIGN PATENT DOCUMENTS 51-33664 9/1976 Japan .
57-53929 11/1982 Japan .
60-186626 9/1985 Japan .
62-2403 1/1987 Japan .
63-15492 4/1988 Japan .

*Primary Examiner*—Henry A. Bennett
*Attorney, Agent, or Firm*—Pollock, Vande Sande & Priddy

[57] ABSTRACT

A hot water circulating system capable of constantly ensuring smooth and effective supply of water from an open tank to a water boiler without causing an air lock phenomenon irrespective of a variation in operating conditions of the system. In the hot water circulating system, a connection pipe is arranged between the open tank and a second communication pipe for interconnecting the water boiler and a radiator so as to directly feed water of a low temperature from the open tank to the second communication pipe. Such construction, even when the supply of water from the open tank to the water boiler is not carried out in synchronism with emptying of water out of the water boiler being heated, to thereby cause a large amount of steam to be produced in the water boiler, permits water introduced from the open tank through the so-arranged connection pipe into the second communication pipe to effectively liquefy the steam introduced into the second communication pipe, resulting in eliminating a trouble that the steam stops the circulation of hot water.

20 Claims, 6 Drawing Sheets

HOT WATER CIRCULATING SYSTEM

BACKGROUND OF THE INVENTION

This invention relates to a hot water circulating system, and more particularly to a hot water circulating system which is adapted to forcibly circulate hot water heated in a water boiler by means of a vapor pressure produced in the water boiler without using a circulating pump.

In a coffee syphon which has been widely used to make coffee, when water in a lower pot of the coffee syphon is boiled, a vapor pressure produced in the lower pot causes the water to be forcibly pushed up into an upper pot of the syphon, resulting in only vapor pressure being in the lower pot. When the syphon is decreased in temperature, vapor in the lower pot is liquefied to cause a negative pressure to be produced therein, so that the water forced up to the upper pot is caused to forcibly flow down to the lower pot by suction, during which coffee is made.

The above-described principle of the coffee syphon has been widely utilized in a conventional hot water circulating system, as disclosed in Japanese Patent Publication No. 33664/1976, Japanese Utility Model Publication No. 53929/1982, Japanese Utility Model Publication No. 2403/1987 and Japanese Patent Application Laid-Open Publication No. 186626/1985. More particularly, the conventional hot water circulating system is so constructed that hot water produced in a water boiler is forcibly fed to a radiator which takes a suitable form such as a fan coil unit, a floor mat or the like by means of a vapor or steam pressure to discharge heat at the radiator and then returned to the water boiler. Unfortunately, in the conventional hot water circulating system, when fresh water is supplied from an open tank to the water boiler after water is emptied out of the water boiler, the supplied water is caused to be immediately boiled to produce a large amount of steam in the water boiler, so that the pressure of the steam hinders the fresh water from being successively fed from the open tank to the water boiler. In order to eliminate such a disadvantage as described above, the assignee proposed a lot of hot water circulating systems, for example, as disclosed in Japanese Patent Publication No. 15492/1988.

Nevertheless, each of the proposed hot water circulating systems as well as the conventional system described above each is disadvantageous in that even when the timing of opening a valve to feed water from the open tank to the water boiler is deviated in only a small amount, a large amount of steam is caused to be produced in the water boiler as soon as water is supplied from the open tank to the water boiler, leading to an air lock phenomenon which interrupts the circulation of water through the system. For example, when a simple valve such as a check valve is used for this purpose, a small degree of variation in temperature at each section of the system, operating conditions or the like causes the circulating cycle to be suddenly interrupted during the operation of the system.

Also, the conventional hot water circulating system has another disadvantage that water escapes in the form of vapor from the open tank in use of the system because the temperature of the water is increased above an ambient temperature, so that it is required to frequently replenish the open tank with water.

SUMMARY OF THE INVENTION

The present invention has been made in view of the foregoing disadvantage of the prior art.

Accordingly, it is an object of the present invention to provide a hot water circulating system which is capable of ensuring smooth operation of the system irrespective of a variation in operating conditions of the system.

It is another object of the present invention to provide a hot water circulating system which is capable of constantly ensuring smooth and satisfactory supply of water from an open tank to a water boiler irrespective of a variation in operating conditions of the system.

It is a further object of the present invention to provide a hot water circulating system which is capable of safely and smoothly feeding water from an open tank to a water boiler even when water fed to the water boiler is about to be boiled or starts to be boiled due to undesired deviation of timing of opening a valve.

It is still another object of the present invention to provide a hot water circulating system which is capable of minimizing or substantially preventing the escape of water vapor from the system to minimize or substantially eliminate the replenishment of water.

It is yet another object of the present invention to provide a hot water circulating system which is capable of stabilizing the operation of a heater for heating a water boiler to render the circulation of hot water stable.

It is a still further object of the present invention to provide a hot water circulating system which is capable of effectively preventing the generation of water hammering during the circulation of hot water.

It is a yet further object of the present invention to provide a hot water circulating system which is capable of increasing heat efficiency during the operation of the system.

In accordance with the present invention, a hot water circulating system is provided. The hot water circulating system includes an open tank communicating with an ambient atmosphere, a water boiler arranged below the open tank, and a first communication pipe through which the open tank and water boiler communicate with each other. Also, the system includes a radiator and a second communication pipe through which the radiator communicates with the water boiler. The radiator also communicates with the open tank through a third communication pipe. The first communication pipe is provided with a first check valve which is closed for a period of time during which the water boiler is pressurized by means of steam. The system further includes a connection pipe arranged between the second communication pipe and the open tank to cause both to communicate with each other therethrough. The connection pipe is provided with a second check valve for preventing fluid from flowing from the second communication pipe to the open tank.

In a preferred embodiment of the present invention, the hot water circulating system may further include a water tank communicating with an ambient atmosphere. The water tank is arranged so as to communicate with the open tank through an air vent and a water feed pipe and provided with a water vapor recovery structure for promoting the recovery of water vapor produced in the open tank.

In a preferred embodiment of the present invention, the heater may comprise a burner, and the system may further include an air fan for feeding combustion air to the burner and an air guide passage arranged so as to communicate with the air fan to feed combustion air therethrough to the air fan. The air guide passage is arranged at a position capable of receiving heat discharged from a high temperature section of the hot water circulating system. The third communication pipe is arranged substantially in the air guide passage.

In a preferred embodiment of the present invention, the system may further include an accumulator arranged at the second communication pipe through which the water boiler and radiator communicate with each other. The accumulator is formed into an inner diameter larger than that of the second communication pipe.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENTS

Now, a hot water circulating system according to the present invention will be described hereinafter with reference to the accompanying drawings.

Figure 1:
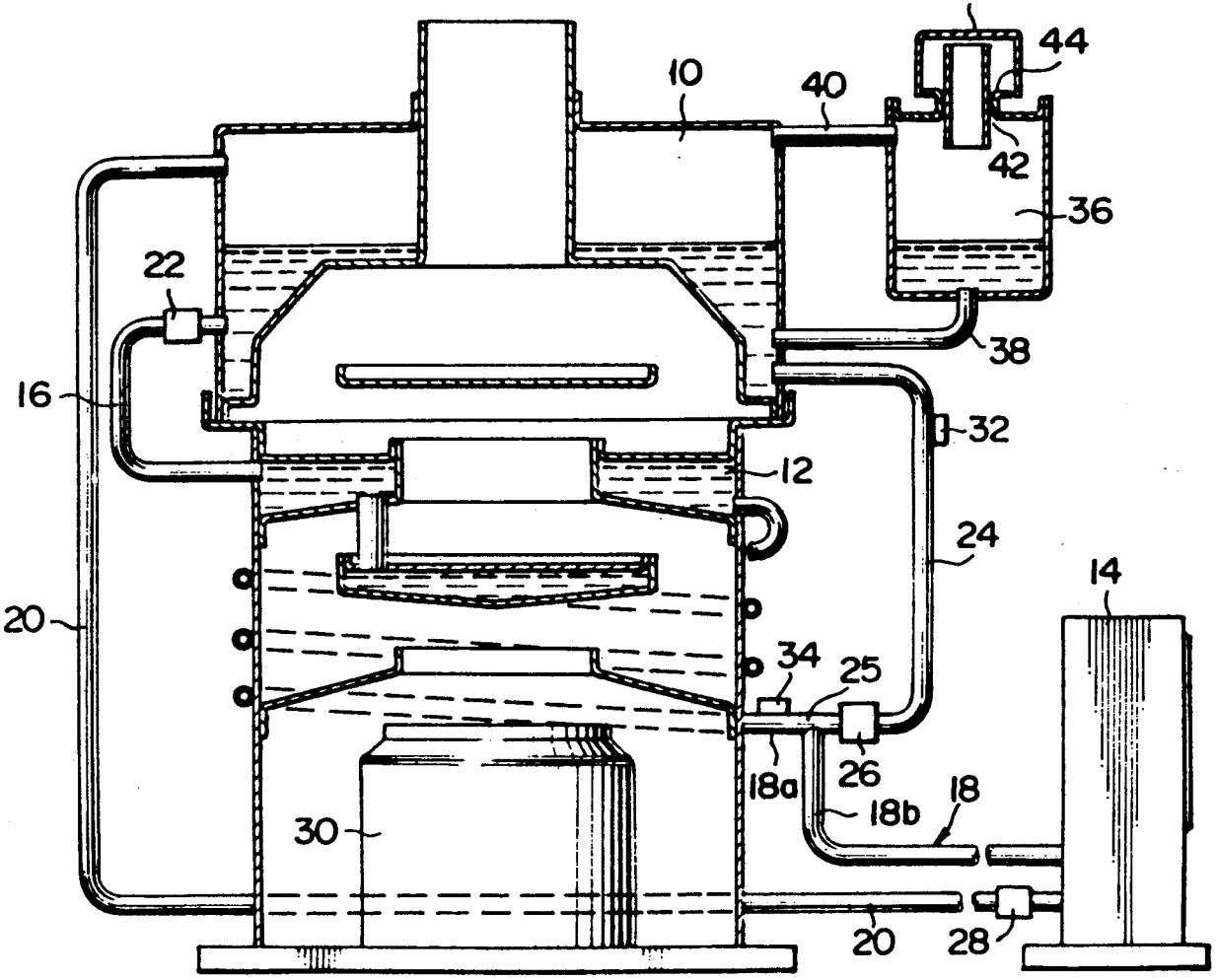
FIG. 1 is a vertical sectional view showing an embodiment of a hot water circulating system according to the present invention.

FIG. 1 shows an embodiment of a hot water circulating system according to the present invention. A hot water circulating system of the illustrated embodiment generally includes an open tank 10 communicating with an ambient atmosphere as described hereinafter, a water boiler 12 arranged below the open tank 10 and a radiator 14 to which hot water produced in the water boiler 12 is supplied. Between the open tank 10 and the water boiler 12 is arranged a first communication pipe 16 so as to cause the open tank 10 and water boiler 12 to communicate with each other therethrough. Between the water boiler 12 and the radiator 14 is arranged a second communication pipe 18 which serves to cause the water boiler 12 and radiator 14 to communicate with each other therethrough. Also, a third communication pipe 20 is provided between the radiator 14 and the open tank 10 so as to connect both to each other therethrough. Thus, a circulating passage is formed in the hot water circulating system of the embodiment to circulate water through the system. The first communication pipe 16 is connected at one end thereof to the bottom of the open tank 10 and at the other end thereof to the water boiler 12. Also, the first communication pipe 16 is provided at the intermediate portion thereof with a first check valve 22.

The hot water circulating system of the illustrated embodiment also includes a connection pipe 24 which is arranged so as to cause the intermediate portion of the second communication pipe 18 and the open tank 10 to communicate with each other therethrough. For this purpose, the connection pipe 24 is connected at one end or the lower end thereof to a connection 25 of the second communication pipe 18 which is the intermediate portion of the pipe 18 and at the other end or upper end thereof to the open tank 10. This results in the second communication pipe 18 being divided into an upstream or first section **18*a* extending between the water boiler 12 and the connection 25 and a second or downstream section 18*b* extending between the connection 25 and the radiator 14 with the connection 25 being interposed therebetween. The connection pipe 24 is provided at the intermediate portion thereof with a second check valve 26. Likewise, the third communication pipe 20 for permitting the radiator 14 and open tank 10 to communicate with each other is provided at the intermediate portion thereof with a third check valve 28. The second check valve 26 serves to prevent fluid from flowing from the second communication pipe 18 through the connection pipe 24 to the open tank 10 and the third check valve 28 acts to prevent fluid from flowing from the open tank 10 through the third communication pipe 20 to the radiator 14**.

The hot water circulating system of the illustrated embodiment further includes a heater 30 which may use fuel gas, fuel oil, electricity or the like as a heating source. In the illustrated embodiment, the heater may comprise a burner. The connection pipe 24 may be provided with a water temperature sensor 32, which is positioned between the second check valve 26 and the open tank 10. The water temperature sensor 32 serves to detect the temperature of water flowing from the open tank 10 through the connection pipe 24 to the second communication pipe 18 when the hot water circulating system starts to circulate water therethrough, resulting in changing over or adjusting the amount of heat generated from the heater 30. For this purpose, the water temperature sensor 32 is electrically connected to the heater 7. The electrical connection between both per se may be conveniently carried out in any suitable manner widely known to those skilled in the art. Alternatively, the water temperature sensor 32 may be arranged at the portion of the first communication pipe 16 positioned between the first check valve 22 and the open tank 10. The second communication pipe 18 connected to the outlet of the water boiler 12 is also provided at the first section **18*a* thereof or the portion thereof on this side of the connection 25 with a high limit switch 34, which serves to detect the interruption of circulation of water through the system due to emptiness of water out of the water boiler 12 occurring by some possibility, to thereby stop the operation of the heater 30. For this purpose, the high limit switch 34** is electrically connected to the heater. The electrical connection between both per se may be carried out in any suitable manner widely known to those skilled in the art.

Moreover, the hot water circulating system of the illustrated embodiment includes a water tank 36 arranged so as to communicate through a water feed pipe 38 and a vent pipe with the open tank 10. The water tank 36 is provided with a water inlet 42, which is provided with a cap 44. The cap 44 is constructed so as to permit the water tank 36 to still communicate with an ambient atmosphere when the cap 44 of the water inlet 42 is covered with an upper lid 47. Thus, the open tank is permitted to communicate with an ambient atmosphere.

Now, the manner of operation of the hot water circulating system of the illustrated embodiment constructed as described above will be described.

When water is fed through the water inlet 42 to the water tank 36, it is then introduced through the water feed pipe 38 to the open tank 10. Then, water is supplied to the first communication pipe 16, water boiler 12, second communication pipe 18, radiator 14, third communication pipe 20 and connection pipe 24. When the heater 30 is ignited or turned on to heat the water boiler 12, water in the water boiler 12 is boiled to produce steam therein, resulting in a pressure in the water boiler 12 being increased. The so-increased pressure causes the first check valve 22 to be closed, so that hot water produced in the water boiler 12 may be forcibly fed through the second communication pipe 18 to the radiator 14, at which the hot water is cooled to discharge heat and then returned to the open tank 10 through the third communication 20. When water in the water boiler 12 is emptied or fully discharged therefrom, the generation of steam in the water boiler 12 is stopped, resulting in the pressure in the water boiler being reduced. Also, steam discharged to the communication pipes 18 and 20 and radiator 14 is liquefied to cause a pressure in each of them to be likewise decreased. This causes water in the open tank 10 to open the first check valve 22, so that the water may be fed to the water boiler 12 to cool it, to thereby liquefy steam remaining in the water boiler 12, resulting in further increasing the negative pressure in the water boiler 12, so that the supply of water from the open tank 10 to the water boiler 12 may be further promoted by suction. During the time, the heater 30 continues to heat the water boiler 12, so that hot water is continuously fed therefrom to the radiator 14 through the second communication pipe 18.

As described above, the hot water circulating system of the illustrated embodiment is so constructed that the connection pipe 24 provided with the second check valve 26 is arranged so as to permit the second communication pipe 18 and open tank 10 to communicate with each other. Such construction causes the second check valve 26 as well as the first check valve 22 to be open when hot water is discharged from the water boiler 12 to reduce a pressure in the water boiler and steam discharged from the water boiler 12 to the second communication pipe 18 and radiator 14 is liquefied therein to further reduce the pressure, so that cold water may be fed from the open tank 10 through the connection pipe 24 to the second communication pipe 18. This results in the cold water fed to the second communication pipe 18 cooling water vapor or steam in the second section **18*b* of the second communication pipe 18 between the connection 25 and the radiator 14 to liquefy it and fully filling the section 18*b* of the pipe 18**.

The cold water fed from the open tank 10 through the connection pipe 24 to the second communication pipe 18 also serves to liquefy water vapor in the first section **18*a* of the second communication pipe 18 between the water boiler 12 and the connection 25. Therefore, even when water is about to be fully emptied out of the water boiler 12 when water in the open tank is supplied through the first check valve 22 of the first communication pipe 16 to the water boiler 12, to thereby produce a large amount of steam in the water boiler 12, water of a low temperature supplied from the open tank through the connection pipe 24 to the second communication pipe 18 liquefies the so-produced steam to keep a pressure in the water boiler 12 at a low level, to thereby ensure smooth successive supply of water from the open tank 10 through the first communication pipe 16 to the water boiler 12, so that the so-supplied water cools the water boiler 12 to produce a negative pressure of a high level in the water boiler sufficient to cause water to be fed from the open tank 10 to the water boiler 12 by suction. This results in the water boiler 12 being filled with water. During the time, the second communication pipe 18** is likewise filled with water. Thus, the subsequent discharge of hot water from the water boiler to the radiator may be smoothly accomplished without any air lock phenomenon.

Further, the system of the illustrated embodiment is constructed in the manner that the third check valve 28 is arranged at the third communication pipe 20 between the radiator 14 and the open tank 10. Such construction causes steam remaining in the second communication pipe 18 to be effectively liquefied by only cold water fed from the open tank 10 through the connection pipe 24 to the pipe 18 rather than water of a relatively high temperature remaining in the radiator 14 and third communication pipe 20, to thereby positively prevent an air lock phenomenon from occurring in the second communication pipe 18 due to the residence of steam in the second communication pipe 18.

As described above, water in the open tank 10 is also used to cool steam in the second communication pipe 18 and water boiler 12, accordingly, an increase in temperature of the water deteriorates the ability of cooling the steam. In order to avoid such a problem, the water temperature sensor 32 may be arranged at the intermediate portion of the connection pipe 24. Such arrangement of the sensor 32 permits the heater 30 to be changed over upon detection of any variation in temperature of the water, to thereby prevent a trouble due to a failure in circulation of hot water and eliminate excessive discharge of heat from the radiator 14. Also, in order to avoid the trouble that the circulation of hot water is interrupted, it is required to stop the operation of the heater 30 as seen in a coffee syphon. The arrangement of the high limit switch 34 on the second communication pipe 18 in the illustrated embodiment causes the switch to detect an excessive or abnormal increase in temperature or the fact that the communication pipe 18 is exposed to steam of a high temperature when the circulation of hot water is interrupted, to thereby stop the heater 30.

As can be seen from the foregoing, the hot water circulating system of the illustrated embodiment is constructed in the manner that the connection pipe 24 is arranged so as to directly feed water of a low temperature from the open tank 10 to the communication pipe 18 for interconnecting the water boiler 12 and radiator 14. Such construction effectively prevents a trouble that steam remains in the second communication, as encountered in the conventional system described above wherein steam in the second communication pipe is liquefied by water after the water boiler is filled with water fed from the open tank. Thus, it will be noted that the embodiment renders the circulation of hot water substantially stable.

Also, the above-described feature of the embodiment permits water fed from the open tank 10 through the connection pipe 24 to the second communication pipe 18 to liquefy steam discharged from the water boiler 10 and to be introduced into the water boiler 12. Thus, even when the first check valve 22 is not operated in synchronism with emptying of water out of the water boiler being heated, to thereby cause a large amount of steam to be produced in the water boiler 12, the water introduced into the second communication pipe 18 effectively liquefies the so-produced steam, resulting in eliminating the trouble that the circulation of hot water is stopped due to such a failure in timing as described above.

Further, the supply of water from the open tank to the water boiler is carried out through the connection pipe 24 as well as the first communication pipe 16, so that the water boiler may be filled with water in a short period of time, resulting in time required for each water circulation cycle being significantly reduced. Moreover, the system of the illustrated embodiment permits a high temperature section such as the open tank 10, water boiler 12 and the like to be arranged outdoors and the radiator 14 to be arranged indoors, so that it is merely required to form a wall of a building with only two holes for the communication pipes 18 and 20. This not only facilitates installation of the hot water circulating system but ensures sanitary safety because exhaust gas or the like is prevented from being discharged indoors.

Figure 2:
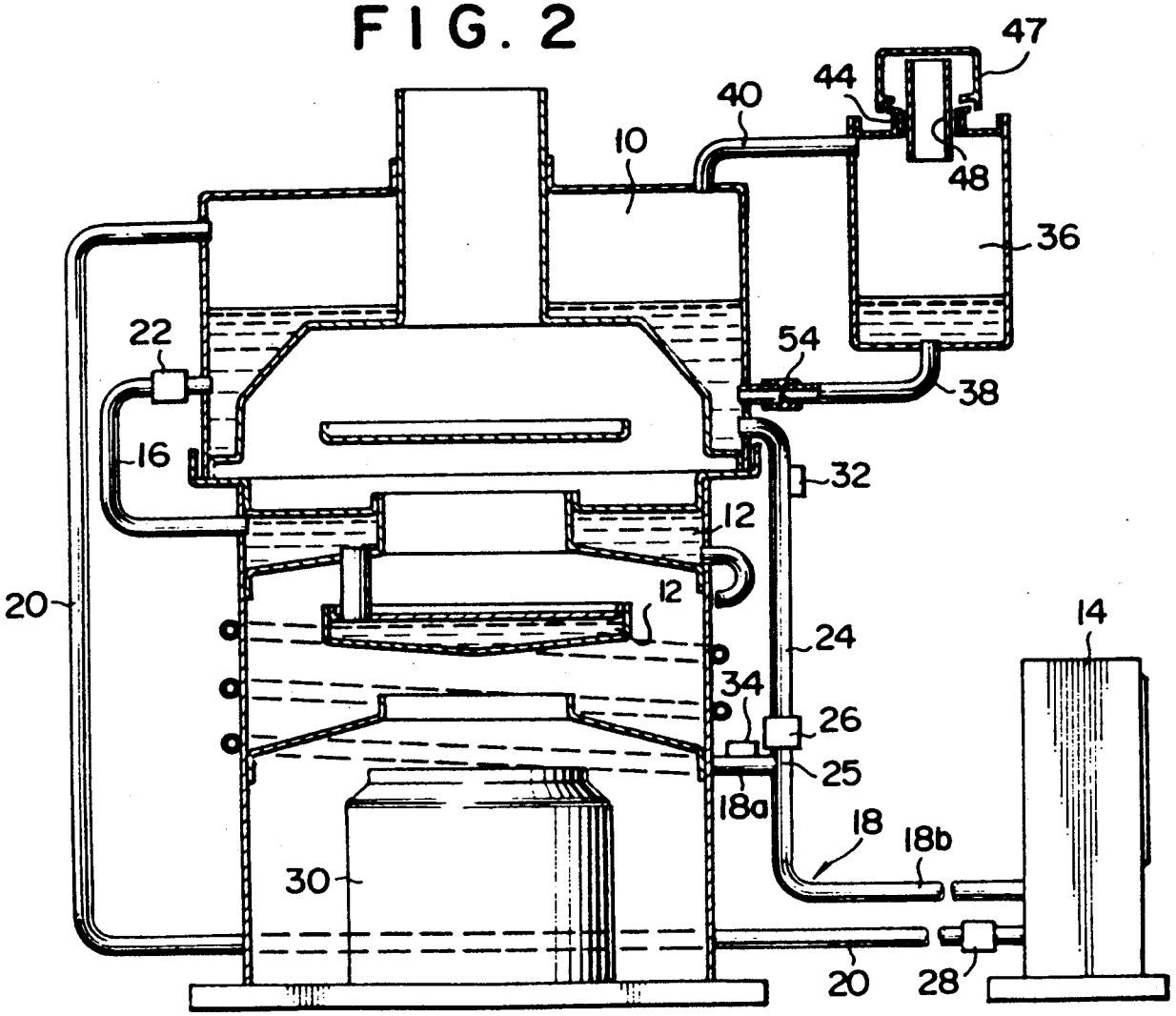
FIG. 2 is a vertical sectional view showing another embodiment of a hot water circulating system according to the present invention.
Figure 3:
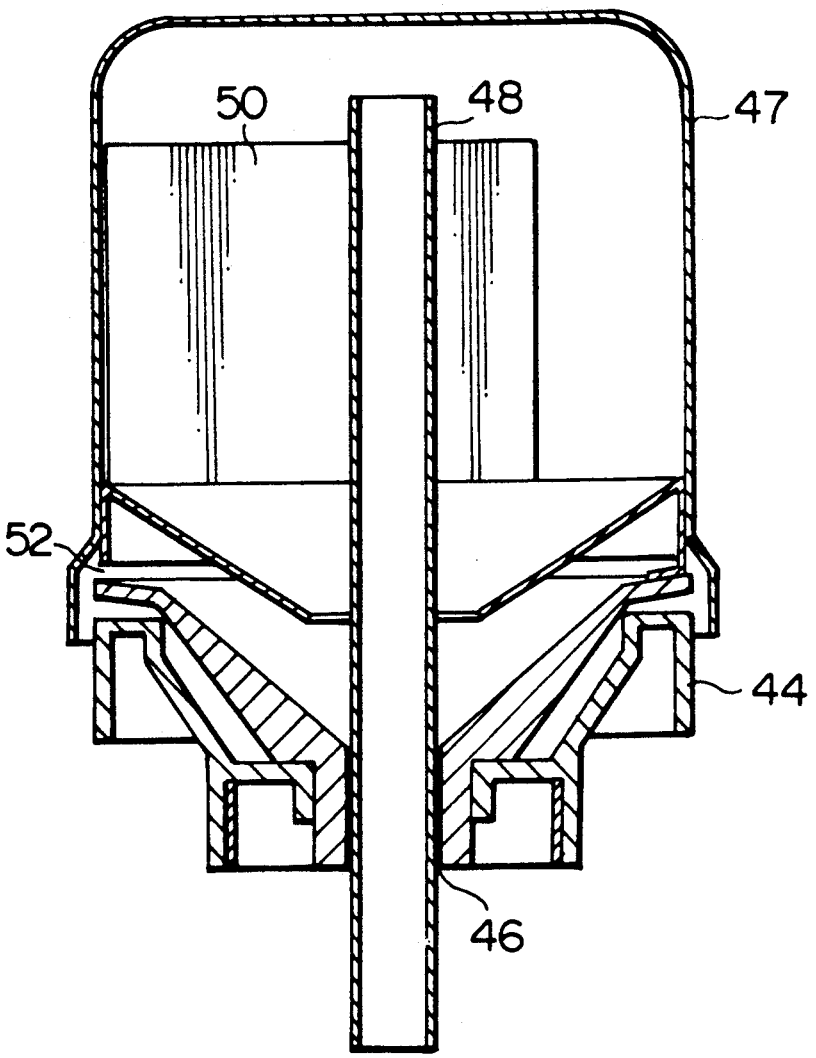
FIG. 3 is a fragmentary enlarged vertical sectional view showing an essential part of the hot water circulating system shown in FIG. 2.

FIGS. 2 and 3 show another embodiment of a hot water circulating system according to the present invention. A hot water circulating system of the embodiment shown in FIGS. 2 and 3 is adapted to carry out the function of substantially preventing the escape of water vapor from the system to substantially eliminate the replenishment of water in addition to the functions of the above-described embodiment. More particularly, in the embodiment, a water tank 36 is provided at the upper portion or upper wall thereof with a funnel-shaped cap 44, which is formed with a through-hole 46. When water is fed through the funnel-shaped cap 44 to the water tank 36, it is then fed in a predetermined amount through a water feed pipe 38 to an open tank 10. The funnel-shaped cap 44 is covered with an upper lid 47. The upper lid 47 is formed so as to have an internal volume. In the illustrated embodiment, it is formed into a cup-like shape. Through the through-hole 46 is loosely inserted a pipe 48, which is suspendedly mounted through a support member 50 on the inner surface of the upper lid 47. The upper lid 47 is connected to or fitted on the funnel-shaped cap 44 through a gap 52 defined therebetween, resulting in the water tank communicating with an ambient atmosphere.

The water feed pipe 38 through which water is fed from the water tank 36 to the open tank 10 may be provided with water flow control means 54 for controlling the flow of water through the water feed pipe 38. The water flow control means 54 functions to increase the flow resistance of the water feed pipe 38 to decrease the velocity of water flowing through the water feed pipe 38 between the open tank 10 and the water tank 36. For this purpose, in the illustrated embodiment, the water flow control means 54 comprises an orifice. Alternatively, it may comprise a pipe line much longer than a vent pipe 40. Such arrangement of the water flow control means 54 causes a variation in water level in the water tank 36 to be about one tenth as much as that in the open tank 10. Also, the temperature of water in the water tank 36 is kept low as compared with that in the open tank, because a variation in water level in the water tank 36 is less.

The remaining part of the embodiment shown in FIGS. 2 and 3 may be constructed in substantially the same manner as the embodiment shown in FIG. 1.

In the hot water circulating system shown in FIGS. 2 and 3, the upper lid 47 is removed together with the pipe 48 from the funnel-shaped cap 44 for feeding water to the water tank 36 from an external water source. Water in the open tank 10 is fed to the water boiler 12, the level of water in the tank 10 is lowered; whereas, when water cooled in a radiator 14 is returned to the open tank 10, it is raised. Thus, the discharge of air from the open tank 10 to an ambient atmosphere and the suction of air from the ambient atmosphere to the open tank are repeatedly carried out through the water tank 36 during the pumping action of the hot water circulating system for circulating hot water therethrough. The discharge of air from the open tank 10 causes a large amount of water to escape in the form of vapor from the open tank, so that it would be required to frequently replenish the open tank 10 with water. In order to avoid such a disadvantage, in the illustrated embodiment, the water tank 36 is arranged separate from the open tank 10 and is provided with the above-described water vapor recovery mechanism or structure for promoting the recovery of water vapor produced in the open tank 10 which is so constructed that the pipe 48 loosely fitted in the through-hole 46 is covered on the outside thereof with the upper lid 47 and the upper lid 47 is fitted on the funnel-shaped cap 44 through the gap 52 defined therebetween. Thus, when air which contains water vapor is forced from the open tank 10 and water tank 36 through the pipe 48 into the upper lid 47, it stays in the upper portion of the inner space of the upper lid 47 because it has a relatively high temperature, so that air which does not overly contain water vapor may be outward discharged through the gap 52. Whereas, when air is introduced from an ambient atmosphere into the upper lid 47 by suction, air containing water vapor which has been collected in the upper portion of the upper lid 47 is caused to flow through the pipe 48 into the water tank 36, so that water vapor which has been once lost from the open tank 10 may be effectively recovered. Also, when water vapor is liquefied on the inner surface of the upper lid 47 to form water droplets, they flow down along the inner surface of the lid 47 and are collected in the funnel-shaped cap 44, resulting in being returned through a gap between the through-hole 46 and the pipe 48 to the water tank 36. Thus, the illustrated embodiment permits water vapor liquefied to be also recovered.

Also, in the illustrated embodiment, the water tank 36 is arranged separate from the open tank 10. Such construction permits water in the water tank 36 to be kept at a low temperature, as compared with that in the open tank 10, so that water vapor produced in the open tank 10 may be liquefied on the inner surface of the water tank 36 as well as on the inner surface of the upper lid 47, resulting in minimize or substantially prevent the discharge of water vapor from the open tank 10 to an ambient atmosphere. Further, the arrangement of the water flow control means 54 at the water feed pipe 38 through which water flows between the water tank 36 and the open tank 10 effectively prevents a rise in level of water in the open tank 10 from immediately leading to a rise in that in the water tank 36. Then, when the level of water in the open tank 10 is lowered in due course of time, a rise in level of water in the water tank 36 is stopped, resulting in a variation in water level in the water tank 36 being suppressed to a degree about one tenth as much as that in the open tank 10. This renders the flowing of water of a relatively high temperature from the open tank 10 to the water tank 36 highly difficult, so that the temperature of water in the water tank 36 may be kept low as compared with that in the open tank 10, to thereby promote the liquefaction of water vapor in the water tank 36.

As can be seen from the foregoing, the illustrated embodiment is constructed in the manner that the water tank 36 is arranged separate from the open tank 10 which must communicate with an ambient atmosphere and in which the suction and discharge of air are repeatedly carried out. Such construction permits water in the water tank to be kept at a temperature lower than that in the open tank 10, resulting in water vapor produced in the open tank being effectively recovered in the water tank 36. Also, the funnel-shaped cap 44 of the water tank 36 through which the water tank and therefore the open tank communicate with an ambient atmosphere is provided with the water vapor recovery structure for promoting the recovery of water vapor which comprises the pipe 48 loosely inserted through the cap 44 and the upper lid 47 fitted on the cap in a manner to define the gap 52 therebetween. Thus, air which is introduced into or discharged from the upper lid 47 through the gap 52 due to a variation in water level in the open tank 10 is not air in the upper space of the water tank 36 but outside air free of water vapor produced in the open tank, so that water vapor reaching the upper lid 47 may be substantially recovered to substantially prevent a decrease in water in the open tank, to thereby minimize or substantially eliminate the replenishment of water.

Figure 4:
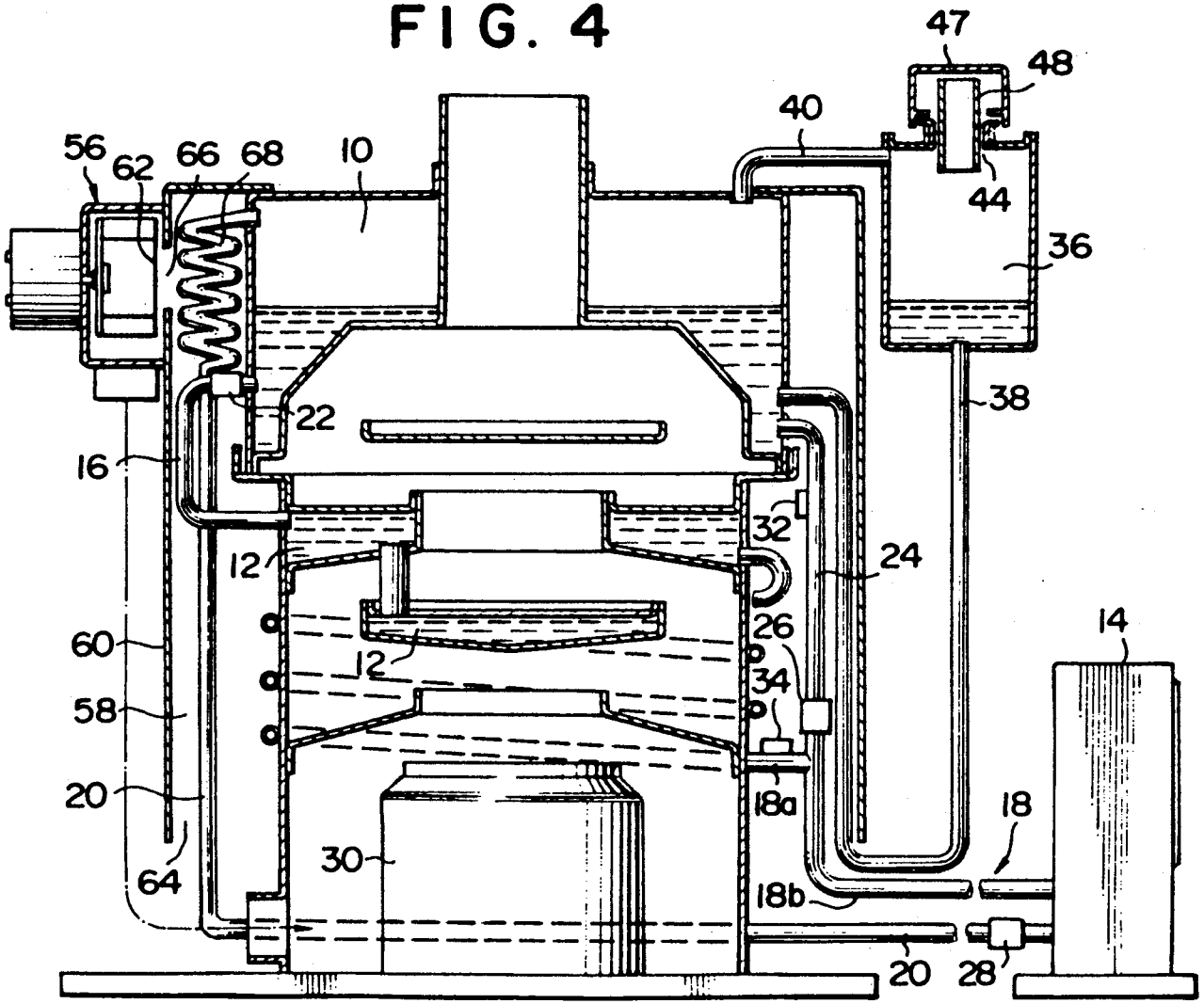
FIG. 4 is a vertical sectional view showing a further embodiment of a hot water circulating system according to the present invention.

FIG. 4 shows a further embodiment of a hot water circulating system according to the present invention. A hot water circulating system of the illustrated embodiment is adapted to stabilize the operation of a burner used as a heater to render the circulation of hot water stable and increase heat efficiency in the operation of the system. More particularly, the present invention, as described above, permits only a radiator to be arranged indoors and sections such as an open tank, a water boiler, a heater and the like other than the radiator to be installed outdoors. For such arrangement of the system, it is required to minimize outdoor heat loss during the operation to increase heat efficiency. When heat energy obtained by recovering heat lost from the system is utilized to increase the temperature of combustion air supplied to a burner acting as a heater for this purpose, the burner is required to exhibit sufficient heat resistance because the deterioration of the burner due to the exposure to a high temperature adversely affects the combustion performance of the burner. Also, a variation in temperature of combustion air fed to the burner causes the operation of the burner to be varied to lead to a failure in stable operation of the burner. The embodiment shown in FIG. 4 is constructed so as to permit the burner to accomplish stable combustion operation.

In the embodiment shown in FIG. 4, as a heater 30 is used a burner, which may use a suitable fuel such as gas, oil or the like. The hot water circulating system of the illustrated embodiment includes an air fan 56 for feeding combustion air to the burner 30 and an air guide passage 58 formed by a wall 60 arranged so as to surround the burner 30 and a water boiler 12. For this purpose, the wall 60 may be formed into, for example, a cylindrical shape. The air fan 56 is provided with an air suction port 62. The air guide passage 58 acts at the lower end thereof as an air inlet 64 and is provided at the upper portion thereof with an air outlet 66 through which the air fan communicates with the air suction port 62 of the air fan 56. A third communication pipe 20 through which a radiator 14 and an open tank 10 communicate with each other is arranged substantially in the air guide passage 58 and is formed at the portion 68 thereof adjacent to the air suction port 62 into a meandering shape, so that the meandering portion 68 may act as a heat exchanger for transferring heat energy of combustion air introduced into the air guide passage 58 and exposed to a high temperature of the burner 30 and water boiler 12 to water flowing through the heat exchanger 68 to cool the combustion air and heat the water, resulting in combustion air of a decreased temperature being fed to the burner 30 by means of the air fan 56.

The remaining part of the embodiment shown in FIG. 4 may be constructed in substantially the same manner as the embodiment shown in FIG. 1 or FIGS. 2 and 3.

The embodiment shown in FIG. 4, as described above, is so constructed that the air guide passage 58 is arranged in a manner to surround the high temperature section of the system or the water boiler 12 and burner 30 operated at a high temperature and the third communication pipe 20 is arranged substantially in the air guide passage 58. Also, the third communication pipe 20 is constructed so as to exhibit heat exchanging function as well. Such construction permits combustion air introduced into the air guide passage 58 to be heated to a high temperature by heat discharged from the water boiler 12 and burner 30 to carry out heat recovery and the so-heated combustion to be cooled by water flowing through the third communication pipe 20, so that the combustion air may be fed to the air fan 56 and then the burner 30 while being constantly kept at a reduced temperature. This causes a difference between the temperature of combustion air immediately after the ignition of the burner and that during the operation of the burner to be minimized, resulting in the operation of the burner being stabilized. Also, this eliminates the necessity of providing the air fan 56 and the like with heat resistance. Further, the above-described construction of the illustrated embodiment permits water in the third communication pipe 20 which has cooled combustion air to be returned to the open tank 10 while being kept at a high temperature, to thereby significantly heat efficiency of the system.

Figure 5:
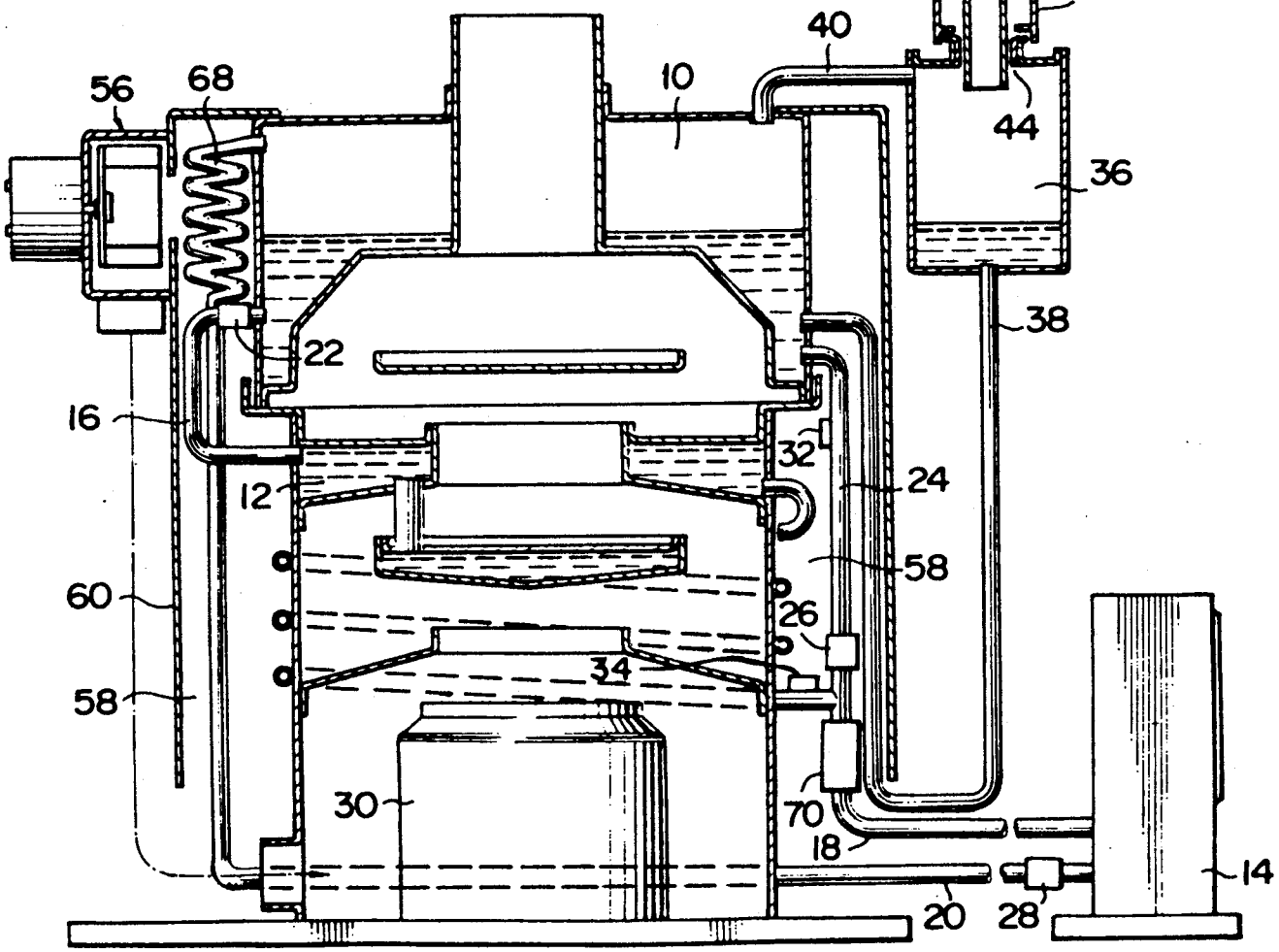
FIG. 5 is a vertical sectional view showing still another embodiment of a hot water circulating system according to the present invention.

FIG. 5 shows still another embodiment of a hot water circulating system according to the present invention. As will be apparent from the foregoing, the present invention is so constructed that the pressure of steam produced in the water boiler forcibly circulates hot water produced in the water boiler to the radiator. Such construction of the present invention often causes steam to be fed from the water boiler through the second communication pipe to the radiator, so that a vapor phase and a liquid phase coexist in the hot water flow passage of the system, particularly, the second communication pipe, resulting in producing a water hammering phenomenon in the passage and rendering the circulation of hot water non-uniform. Also, this leads to heat loss to a degree sufficient to deteriorate heat efficiency of the system. A hot water circulating system shown in FIG. 5 is adapted to eliminate the generation of water hammering and rendering the circulation of hot water uniform, as well as increase heat efficiency.

More particularly, the hot water circulating system of the embodiment shown in FIG. 5 includes an accumulator 70 formed into an inner diameter significantly larger than that of a second communication pipe 18 through which a water boiler 12 and a radiator 14 communicate with each other and arranged at the second communication pipe 18. Such arrangement of the accumulator 70 permits at least a part of steam fed to the second communication pipe 18 to be liquefied in the accumulator 70 to substantially decrease or eliminate undesired feeding of steam to the radiator 14.

Figure 6:
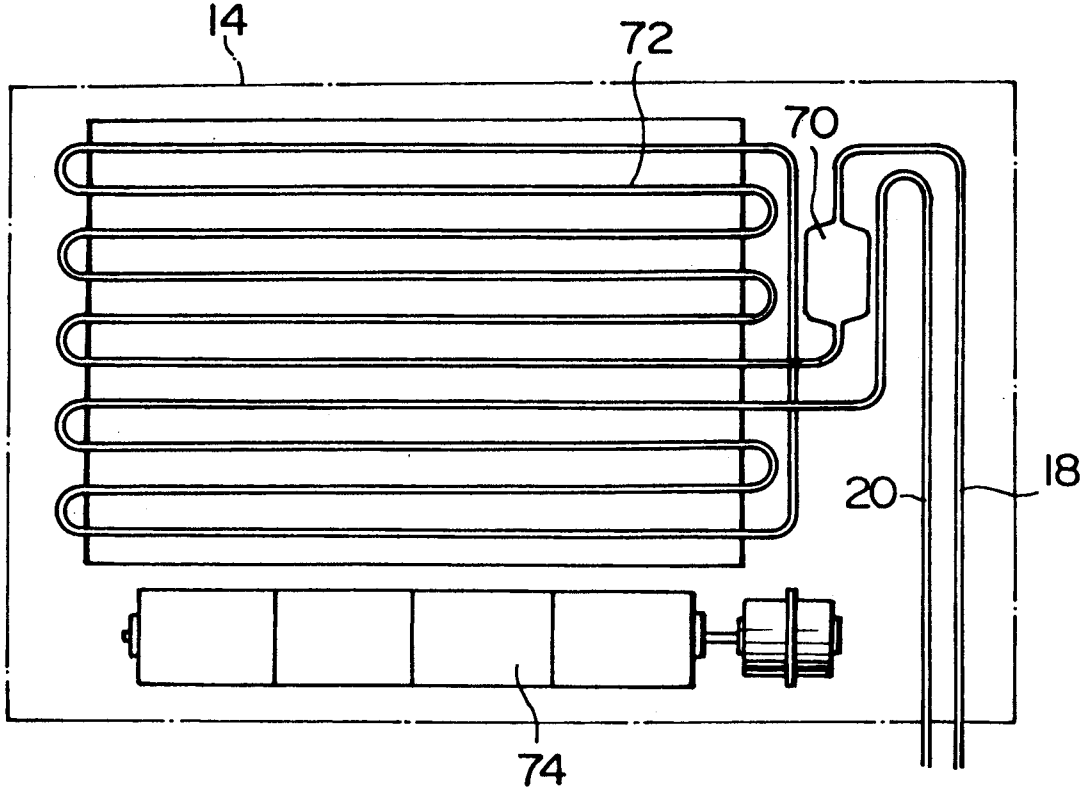
FIG. 6 is a fragmentary schematic view showing an essential part of a modification of the hot water circulating system shown in FIG. 5.

In the illustrated embodiment, the accumulator 70 is positioned adjacent to the water boiler 12. More particularly, it is positioned in proximity to the water boiler 12 in an air guide passage 58, so that heat radiated from the accumulator may be used for heating combustion air introduced through the air guide passage to an air fan 56. Also, the arrangement of the accumulator in the air guide passage 58 causes the discharge of heat from the accumulator to be promoted to effectively liquefy steam in the second communication pipe 18. Alternatively, the accumulator 70 may be arranged in such a manner as shown in FIG. 6. More specifically, in FIG. 6, the accumulator 70 is positioned in the radiator 14 and in proximity to a radiator body or heat radiating section 72 of the radiator 14, so that the discharge of heat from the accumulator 70 may be carried out together with the radiation of heat from the heat radiating section 72 of the radiator 14. Also, the arrangement of the accumulator in the manner shown in FIG. 6 substantially fully liquefies steam in the second communication pipe 18 because it is arranged apart from the water boiler 12 to permit a part of the steam to be liquefied before reaching the accumulator 70, resulting in hot water being effectively fed to the radiator 14.

The remaining part of the embodiment may be constructed in substantially the same manner as the embodiment shown in FIG. 1 or FIG. 4.

As can be seen from the foregoing, the embodiment shown in FIGS. 5 and 6 is so constructed that the accumulator 70 is arranged at the second communication pipe 18 to smoothen the flow of hot water and steam through the second communication pipe 18 and substantially liquefy the steam, to thereby render the flow of hot water to the radiator 14 uniform and significantly decrease the amount of steam fed to the radiator, resulting in substantially preventing the generation of water hammering.

While preferred embodiments of the invention have been described with a certain degree of particularity with reference to the drawings, obvious modifications and variations are possible in the light of the above teachings. It is therefore to be understood that within the scope of the appended claims, the invention may be practiced otherwise than as specifically described.

I claim:

1. A hot water circulating system comprising:

an open tank communicating with an ambient atmosphere;

a water boiler arranged below said open tank;

a heater for heating said water boiler;

a first communication pipe arranged so as to cause said open tank and water boiler to communicate with each other therethrough;

a radiator;

a second communication pipe arranged to as to cause said water boiler and radiator to communicate with each other therethrough;

a third communication pipe arranged so as to cause said radiator and open tank to communicate with each other therethrough;

said first communication pipe being provided with a first check valve which is closed for a period of time during which said water boiler is pressurized; and, a connection pipe arranged so as to cause said second communication pipe and said open tank to communicate with each other therethrough;

said connection pipe being provided with a second check valve for preventing fluid from flowing from said second communication pipe to said open tank, and for providing a flow of fluid from said open tank to said second communication pipe while fluid is flowing from said open tank to said water boiler through said first communication pipe.

2. A hot water circulating system as defined in claim 1, wherein said third communication pipe is provided with a third check valve for preventing fluid from flowing from said open tank to said radiator.

3. A hot water circulating system as defined in claim 1 further comprising a water temperature sensor for detecting the temperature of water in said open tank.

4. A hot water circulating system as defined in claim 3, wherein said water temperature sensor is arranged at said connection pipe in a manner to be positioned between said second check valve and said open tank.

5. A hot water circulating system as defined in claim 3, wherein said water temperature sensor is arranged at said first communication pipe in a manner to be positioned between said first check valve and said open tank.

6. A hot water circulating system as defined in claim 1 further comprising a high limit switch for detecting emptiness of water out of said water boiler being heated to stop heating of said water boiler.

7. A hot water circulating system as defined in claim 6, wherein said high limit switch is arranged at said second communication pipe in a manner to be positioned between said water boiler and said connection pipe.

8. A hot water circulating system as defined in claim 1 further comprising a water tank communicating with an ambient atmosphere;

said water tank being arranged so as to communicate with said open tank through an air vent and a water feed pipe;

said water tank being provided with a water vapor recovery structure for promoting the recovery of water vapor produced in said open tank.

9. A hot water circulating system as defined in claim 8, wherein said water vapor recovery structure comprises a funnel-shaped cap provided at the upper portion of said water tank and formed with a through-hole, a pipe loosely inserted via said through-hole and an upper lid of an internal volume put on said funnel-shaped cap through a gap defined therebetween.

10. A hot water circulating system as defined in claim 9, wherein said pipe is supported on said upper lid.

11. A hot water circulating system as defined in claim 8 further comprising water flow control means arranged at said water feed pipe to decrease the velocity of water flowing between said open tank and said water tank.

12. A hot water circulating system as defined in claim 11, wherein said water flow control means comprises an orifice.

13. A hot water circulating system as defined in claim 1, wherein said heater comprises a burner.

14. A hot water circulating system as defined in claim 13 further comprising an air fan for feeding combustion air to said burner; and an air guide passage arranged so as to communicate with said air fun to feed combustion air therethrough to said air fan;

said air guide passage being arranged at a position capable of receiving heat discharged from a high temperature section of the hot water circulating system;

said third communication pipe being arranged substantially in said air guide passage.

15. A hot water circulating system as defined in claim 14, wherein said air guide passage is formed so as to surround said burner and water boiler.

16. A hot water circulating system as defined in claim 14, wherein said third communication pipe is formed at the portion thereof adjacent to said air fan into a meandering shape so that it may function as a heat exchanger.

17. A hot water circulating system as defined in claim 1 further comprising an accumulator arranged at said second communication pipe through which said water boiler and radiator communicate with each other;

said accumulator being formed into an inner diameter larger than that of said second communication pipe.

18. A hot water circulating system as defined in claim 17, wherein said accumulator is positioned in said radiator in a manner to be proximity to a heat radiating section of said radiator.

19. A hot water circulating system as defined in claim 14 further comprising an accumulator arranged at said second communication pipe through which said water boiler and radiator communicate with each other;

said accumulator being formed into an inner diameter larger than that of said second communication pipe.

20. A hot water circulating system as defined in claim 19, wherein said accumulator is positioned in said air guide passage.

* * * * *